US005678113A

United States Patent [19]

Kojima

[11] Patent Number: 5,678,113

[45] Date of Patent: Oct. 14, 1997

[54] AUTOMATIC FILM PROCESSING APPARATUS

[75] Inventor: Masayuki Kojima, Wakayama, Japan

[73] Assignee: Noritsu Koki Co., Ltd., Wakayama, Japan

[21] Appl. No.: 729,026

[22] Filed: Oct. 10, 1996

[30] Foreign Application Priority Data

Oct. 25, 1995 [JP] Japan ..... 7-278106

[51] Int. Cl.[6] ..... G03D 3/08; G03D 13/08

[52] U.S. Cl. ..... 396/567; 396/570; 396/578; 396/620

[58] Field of Search ..... 396/564, 567, 396/570, 578, 594, 595, 598, 603, 620, 622, 624, 511, 512, 647

[56] References Cited

U.S. PATENT DOCUMENTS

| | | | |
|---|---|---|---|
| 4,831,401 | 5/1989 | Uchiyama et al. | 396/594 |
| 5,229,802 | 7/1993 | Shiota et al. | 396/564 |
| 5,452,037 | 9/1995 | Blackman | 396/594 |
| 5,493,352 | 2/1996 | Reddig et al. | 396/647 |
| 5,541,699 | 7/1996 | Yamaguchi | 396/620 |
| 5,561,489 | 10/1996 | Yamaguchi et al. | 396/567 |
| 5,600,394 | 2/1997 | DeCook et al. | 396/647 |

*Primary Examiner*—A. A. Mathews

*Attorney, Agent, or Firm*—Wenderoth, Lind & Ponack

[57] ABSTRACT

An automatic film processing apparatus includes a detector plate which is projected upward when cartridges are placed in cartridge case in an adverse manner. Limit switches detect the upward displacement of the detector plate and present a warning signal to an operator.

4 Claims, 6 Drawing Sheets

AUTOMATIC FILM PROCESSING APPARATUS

BACKGROUND OF THE INVENTION

The present invention relates to an automatic film processing apparatus and particularly, to a processing apparatus for feeding out sheets of film one by one from respective cartridges installed in a cartridge case and subjecting them to development and other processes.

Such a processing apparatus for feeding out sheets of film one by one from their respective cartridges installed in a cartridge case is known in the form of an automatic film development apparatus.

In the automatic film development apparatus sheets of film are fed out one by one from their respective cartridges installed in a cartridge case, developed, and rewound back into their respective cartridges.

If the cartridges are installed in the cartridge case in an adverse manner or orientation, barcodes provided on the cartridges may be read incorrectly by a sensor reader mounted beneath the cartridge case in the automatic film development apparatus. Such incorrectly oriented cartridges as well as will fail to release their film sheets, causing interruption of the automatic processing operation. Recovery from such interruption is not an easy task.

For avoiding such an interruption, the installation of the cartridges in the cartridge case is viewed and checked by the operator in the prior art.

However, the cartridges in the cartridge case are all alike when viewed from above and even if some are installed in a wrong direction, they appear in square forms and will hardly be detected.

It is an object of the present invention to provide an automatic film processing apparatus capable of sensing the orientation of cartridges in a cartridge case without viewing, thus to increase the efficiency of operation.

SUMMARY OF THE INVENTION

For achievement of the above object of the present invention, an automatic film processing apparatus includes cartridge cases, each having therein a number of pockets each of which has a shape corresponding to an elaborate configuration of a film cartridge. A detecting means is capable of detecting whether at least one of the film cartridges carried in their respective pockets of any cartridge case is positioned higher than a predetermined level in order to determine whether or not the cartridges are installed in a correct orientation.

DETAILED DESCRIPTION OF THE PREFERRED EMBODIMENTS

Embodiment 1

Figure 1:
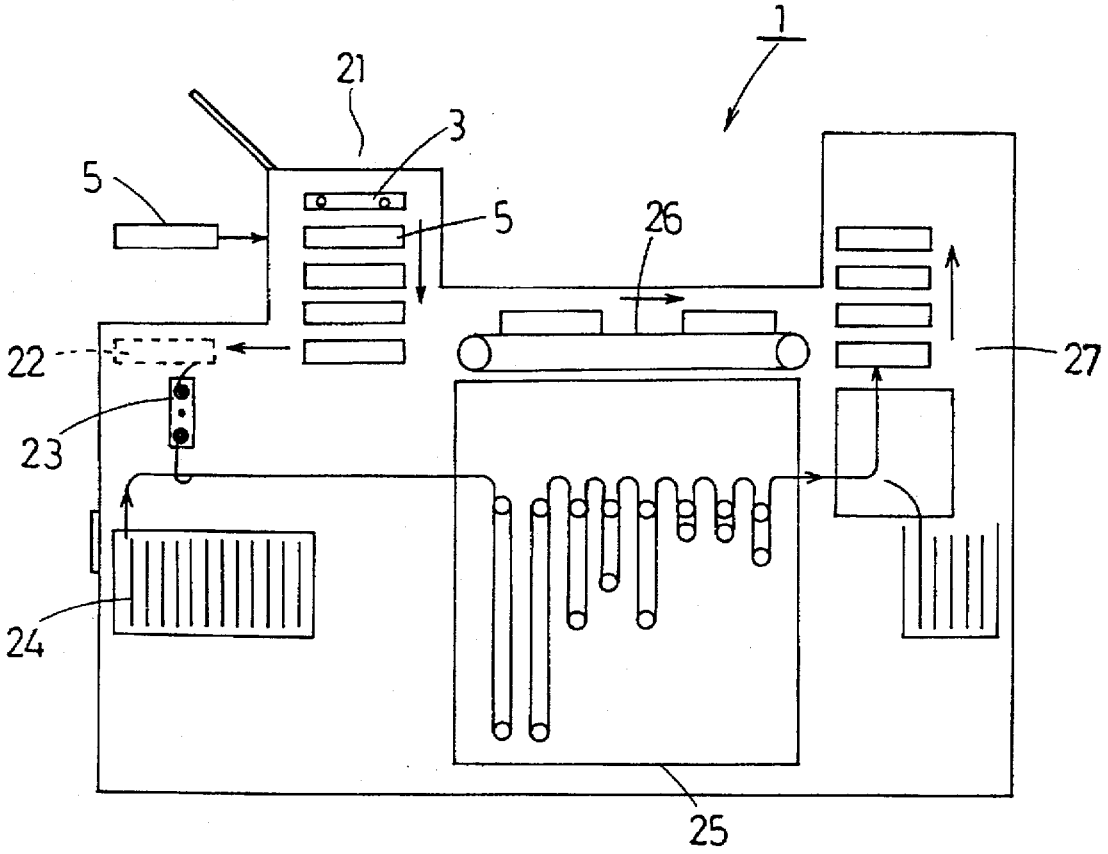
FIG. 1 is a schematic view of the entire arrangement of an automatic film processing apparatus according to the present invention.

An embodiment of the present invention will be described referring to FIGS. 1 to 6.

When a cartridge case 5 carrying a number of film cartridges 4 therein is loaded into a case loading station 21, a detector plate 3 with limit switches 6A and 6B installed in a detecting mechanism 7 are lowered to a predetermined level. The detector plate 3 may be fixedly mounted to the predetermined level for allowing the cartridge case 5 to be loaded along and on the lower end thereof.

The detecting mechanism 7 has support rods 71 thereof extending across slots 31 provided in the detector plate 3 to support the same.

The detector plate 3 is supported at the slots 31 for upward and downward displacement in relation to the support rods 71.

The orientation of the cartridges 4 is examined by the detector plate 3 in the following fashion.

Figure 2:
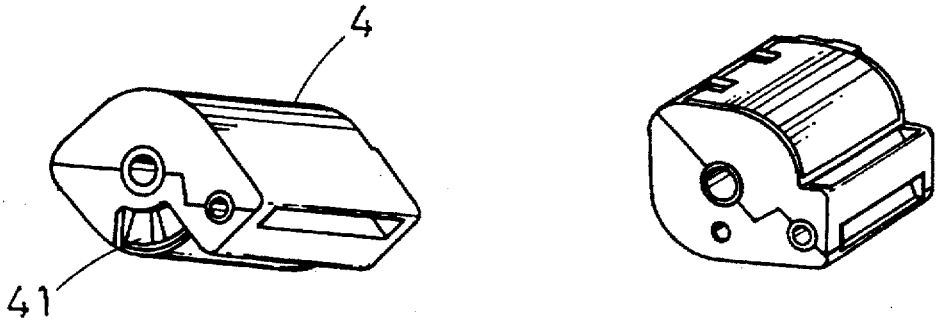
FIG. 2 is a perspective view showing the configuration of a cartridge.
Figure 3:
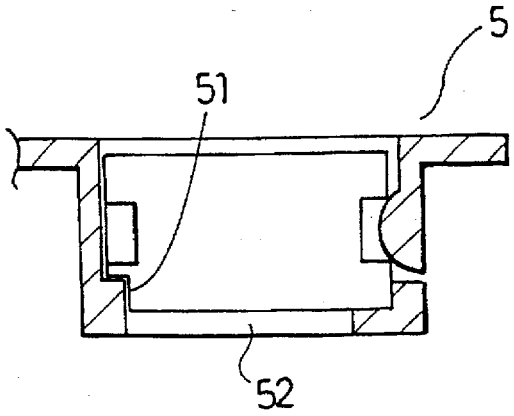
FIG. 3 is a cross sectional view showing a primary part of a cartridge case.
Figure 6:
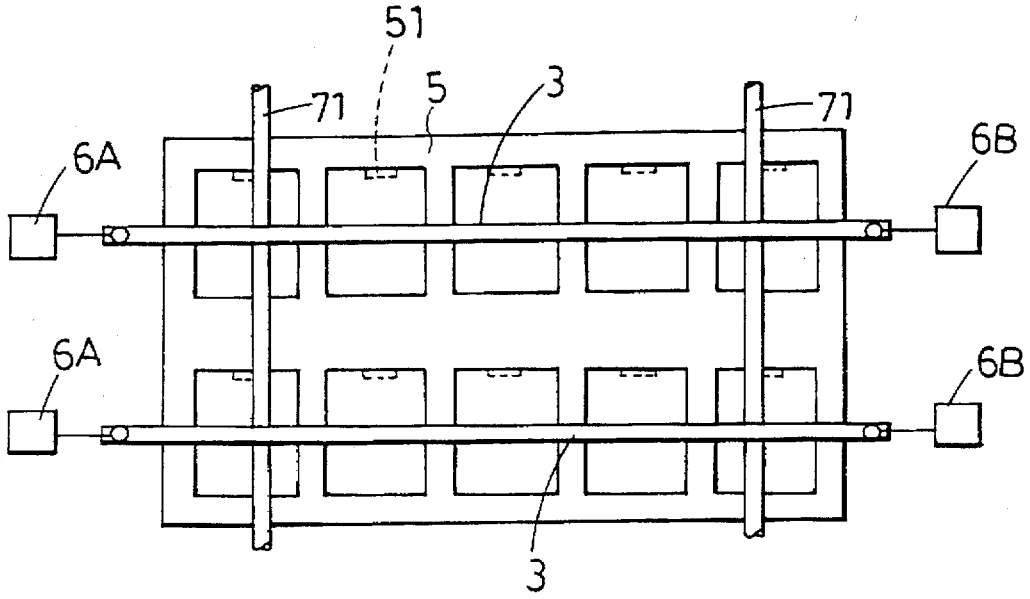
FIG. 6 is a plan view of the primary section of the automatic film processing apparatus.

The cartridge 4 has a tailored recess 41 partially provided in one side thereof, as best shown in FIG. 2, and a barcode printed on a base side thereof near the opening. The cartridge case 5 has a projection 51 thereof formed to fit into the recess 41 when the cartridge 4 is installed in its correct orientation, as shown in FIGS. 3 and 6, and a barcode reading aperture 52 provided in the bottom thereof.

Figure 4:
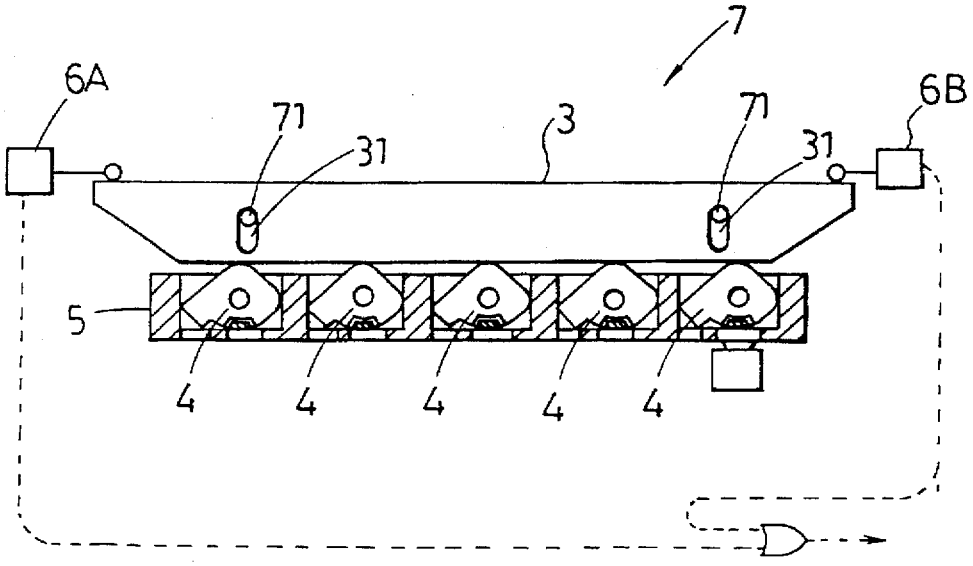
FIG. 4 is a side sectional view of a primary section of the automatic film processing apparatus.
Figure 5:
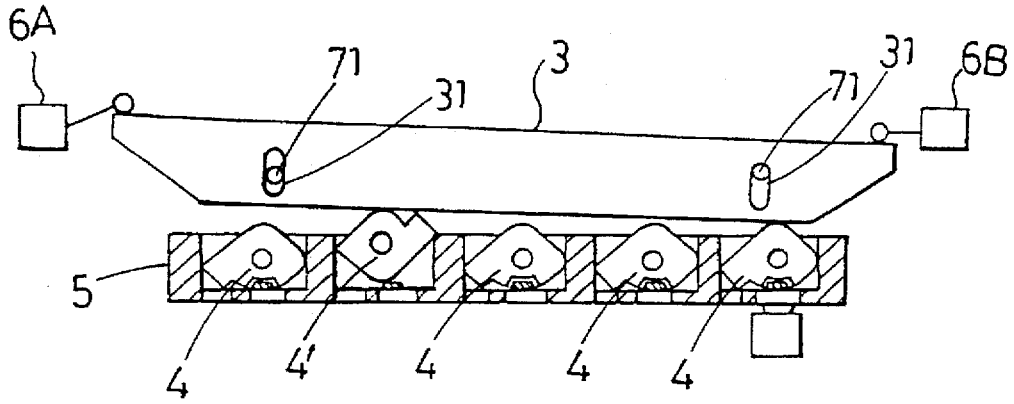
FIG. 5 is a further side sectional view of the primary section of the automatic film processing apparatus.

As the cartridges 4 are loaded in their correct orientation, their recesses 41 come in direct engagement with the corresponding projections 51 of the cartridge case 5 as shown in FIG. 4. If any of the cartridges 4 is in a wrong orientation, it is blocked by the projection 51 and remains protruded as shown in FIG. 5.

This causes the detector plate 3 to be lifted up with at least one of the limit switches 6A and 6B activated to produce and present a warning signal to the operator.

The warning signal is indicative of the incorrect orientation of the cartridge 4 and allows the operator to unload the cartridge case 5 from the case loading station 21 and after correcting the orientation of the cartridge 4, load it back again.

As all the cartridges 4 have been installed in the correct orientation in the cartridge case 5, the procedure of development is commenced.

The procedure starts with conveying the cartridge case 5 to a film unloading station 22.

Figure 7:
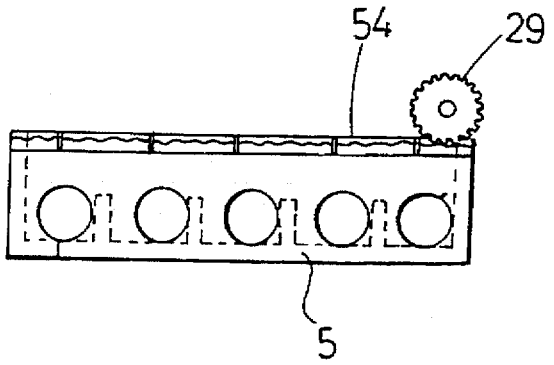
FIG. 7 is a side view of the primary section of the automatic film processing apparatus.
Figure 8:
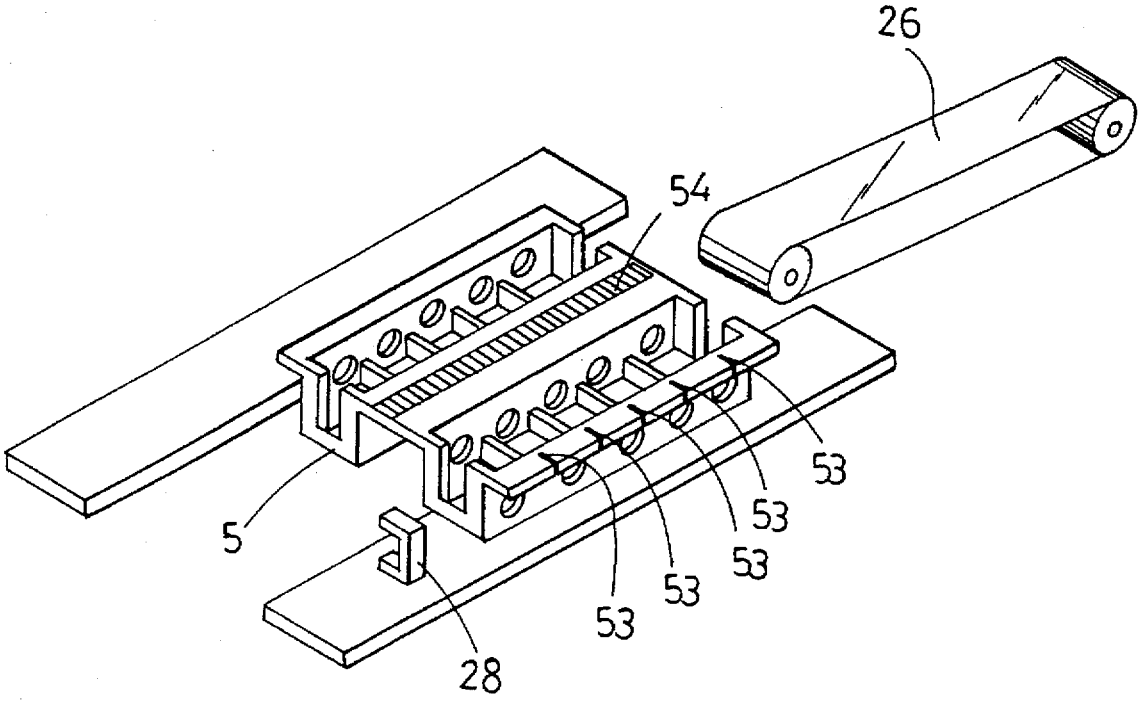
FIG. 8 is a perspective view of the primary section of the automatic film processing apparatus.

More specifically, the cartridge case 5 is conveyed step by step by a drive gear 29, located thereabove and meshed with and driving a rack 54 mounted on the upper side thereof, as shown in FIG. 7. Referring to FIG. 8, the cartridge case 5 has a row of slits 53 provided in one edge thereof at equal intervals corresponding to the cartridges 4 therein. Each step movement of the cartridge case 5 is hence executed by an action of the drive gear 29 synchronized with the detection of the corresponding slit 53 by a photointerruptor 28 mounted in the film unloading station 22.

Figure 9:
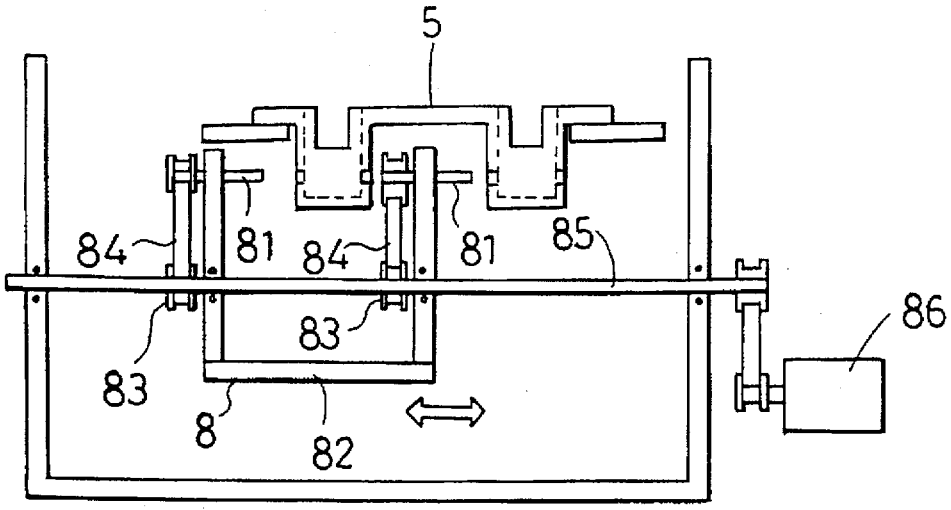
FIG. 9 is a cross sectional view of the primary section of the automatic film processing apparatus.

Upon the cartridge case 5 reaching and stopping at a specific location, a film unloading unit 8 is forwarded at a right angle to the conveying direction of the cartridge case 5 so that a drive shaft 81 comes into engagement with the spool of the first cartridge 4 in the cartridge case 5, as shown in FIG. 9. Rotation of a motor 86 drives via the drive shaft 81 the spool of the first cartridge 4 to release a sheet of film.

In more detail, the film unloading unit 8 includes a pair of the drive shafts 81 for matching a construction of the cartridge case 5. The two drive shafts 81 are mounted on a frame 82 of the film unloading unit 8 which can slide along and on an axle 85. The two shafts 81 are driven by belts 84 running on pulleys 83 respectively which are movable laterally with the frame 82. More particularly, the frame 82 is slidably mounted on the axle 85 for relative movement therebetween. The pulleys 83 are movable axially of the axle 85 and also are rotatable together with the axle 85. For this purpose, key and slot means e.g. of polygon cross section are provided on the pulleys 83 and the axle 85.

The film sheet unloaded from the cartridge 4 is temporarily taken up in an intermediate cartridge 23 and after the intermediate cartridge 23 is turned upside down, withdrawn and joined to a film leader 24. During operation, the drive gear 29 advances by another step the cartridge case 5 to feed the second cartridge 4 at the unloading location.

Then, the film unloading unit 8 repeats the film unloading operation.

When all the cartridges 4 in the cartridge case 5 have been exhausted, the cartridge case 5 is conveyed by a conveyor belt 26 to a film loading station 27.

The sheets of film from the cartridges 4 are developed in a processing station 25 and, after being separated from the film leaders, are loaded back into their respective cartridges 4 in the cartridge case 5 having been conveyed. For loading the sheets of film into the cartridge 4, ID data on the cartridge 4 is examined for collation.

Embodiment 2

Figure 10:
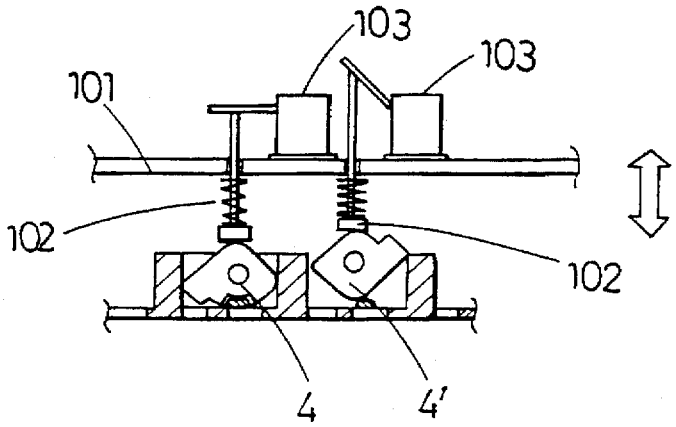
FIG. 10 is an explanatory view showing a second embodiment of the present invention.
Figure 11:
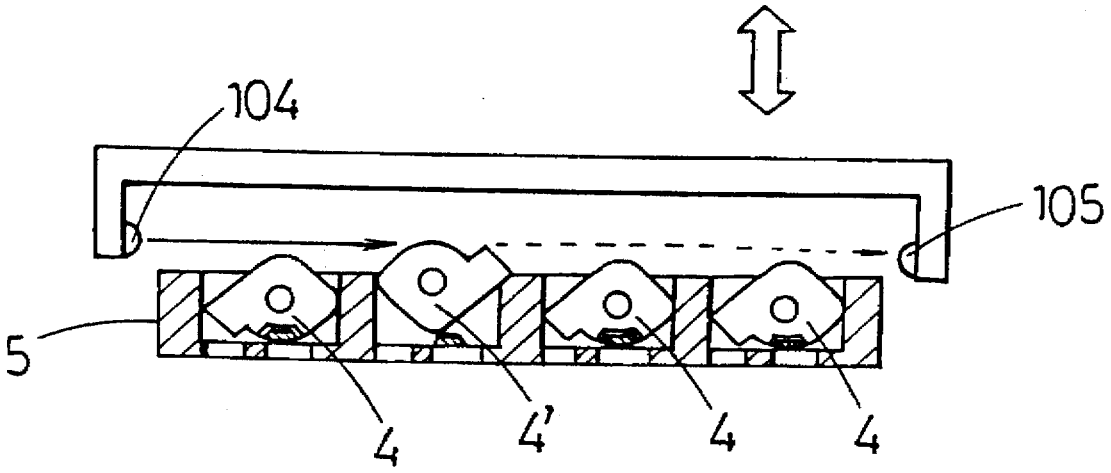
FIG. 11 is an explanatory view showing a third embodiment of the present invention.

The detecting means may be a height detector mechanism, shown in FIG. 10, comprising a plate 101, detector bars 102, and limit switches 103 for examining the orientation of cartridges. If any cartridge 4' is installed in a wrong orientation with the plate 101 being lowered, it blocks the bar 102 causing the limit switch 103 to switch on.

Embodiment 3

The detecting means may be a combination of a light emitter 104 and a photoreceptor 105 located over the cartridge case 5. When a beam of light from the light emitter 104 is interrupted, there is at least one cartridge which is installed in a wrong orientation.

Preferably, the detecting means is arranged to be movable upward and downward for allowing a cartridge case 5 to pass for loading.

The present invention is not limited to the automatic film processing apparatus, but rather is applicable with equal success to any apparatus such as an automatic printer which handles a cartridge case(s).

According to the present invention, the installation of cartridges is significantly examined to prevent any possible trouble, hence contributing both to higher efficiency and to smooth operation of the automatic film processing apparatus.

What is claimed is:

1. An automatic film processing apparatus including cartridge cases, each having therein a number of pockets each having a shape corresponding to an elaborate configuration of a film cartridge, said apparatus comprising:

a detecting means capable of detecting that at least one of the film cartridges carried in their respective pockets of any cartridge case is positioned higher than a predetermined level in order to determine whether or not the cartridges are installed in the correct orientation.

2. The automatic film processing apparatus of claim 1, wherein said detecting means comprises:

a detector plate;

support rods extending across slots provided in said detector plate to support upward and downward displacement of said detector plate; and limit switches presenting a warning signal in accordance with upward displacement of said detector plate.

3. The automatic film processing apparatus of claim 1, wherein said detecting means comprises:

a plate;

detector bars movable upward and downward and extending across slots provided in said plate; and limit switches presenting a warning signal in accordance with upward displacement of said detector bars.

4. The automatic film processing apparatus of claim 1, wherein said detecting means comprises:

a light emitter emitting a beam of light toward a photoreceptor, said photoreceptor presenting a warning signal when there is at least one cartridge which is installed in a wrong orientation and said beam of light from said light emitter is interrupted by such at least one cartridge.

* * * * *